US009091968B2

(12) United States Patent
Hara et al.

(10) Patent No.: US 9,091,968 B2
(45) Date of Patent: Jul. 28, 2015

(54) IMAGE FORMING APPARATUS HAVING TRANSFER BIAS CONTROL

(71) Applicant: Konica Minolta, Inc., Tokyo (JP)

(72) Inventors: Kazuyoshi Hara, Itami (JP); Takahiro Kuroda, Toyokawa (JP); Hidetoshi Noguchi, Tahara (JP); Satoru Shibuya, Chiryu (JP)

(73) Assignee: KONICA MINOLTA, INC., Tokyo (JP)

( * ) Notice: Subject to any disclaimer, the term of this patent is extended or adjusted under 35 U.S.C. 154(b) by 125 days.

(21) Appl. No.: 13/887,954

(22) Filed: May 6, 2013

(65) Prior Publication Data

US 2013/0294792 A1 Nov. 7, 2013

(30) Foreign Application Priority Data

May 7, 2012 (JP) ..... 2012-106007

(51) Int. Cl.
*G03G 15/16* (2006.01)

(52) U.S. Cl.
CPC ..... *G03G 15/1665* (2013.01); *G03G 15/1675* (2013.01)

(58) Field of Classification Search
CPC ..... G03G 15/1645; G03G 15/1665; G03G 15/1675; G03G 15/165; G03G 2215/00763
USPC ..... 399/66, 302, 303, 308, 314
See application file for complete search history.

(56) References Cited

U.S. PATENT DOCUMENTS 5,151,736 A * 9/1992 Ohzeki et al. ..... 399/66
5,761,568 A * 6/1998 Haragakiuchi et al. ..... 399/44
6,111,594 A * 8/2000 Jeong ..... 347/140
2003/0185581 A1* 10/2003 Hisada ..... 399/45
2005/0141911 A1* 6/2005 Nakaso ..... 399/66
2011/0008065 A1* 1/2011 Yanagihara ..... 399/66

FOREIGN PATENT DOCUMENTS

JP 04-251276 9/1992
JP 08166727 A 6/1996
JP 09190092 A 7/1997

(Continued)

OTHER PUBLICATIONS

Japanese Office Action dated Aug. 5, 2014 in counterpart Japanese Application No. 2012-106007.

(Continued)

*Primary Examiner* — Robert Beatty
(74) *Attorney, Agent, or Firm* — Holtz, Holtz, Goodman & Chick PC

(57) ABSTRACT

An image forming apparatus having: an image support that supports a toner image; a transfer member adapted to sandwich with the transfer member and the image support; a voltage application unit that applies a transfer bias voltage to the transfer member; a current detecting unit that detects transfer current flowing from the voltage application unit to the transfer material after transfer processing on the transfer material starts; and a control unit that sets an upper limit of transfer current on the basis of a value of the transfer current detected by the current detecting unit, and thereafter further acquires a transfer current value from the current detecting unit to control a transfer bias voltage generated by the voltage application unit, such that the transfer current value during transfer does not exceed the upper limit.

6 Claims, 11 Drawing Sheets

(56) References Cited

FOREIGN PATENT DOCUMENTS

| | | | |
|---|---|---|---|
| JP | 2000187404 | A | 7/2000 |
| JP | 2001092277 | A | 4/2001 |
| JP | 2002148964 | A | 5/2002 |
| JP | 2002196544 | A | 7/2002 |
| JP | 2002304067 | A | 10/2002 |
| JP | 2008-275946 | | 11/2008 |
| JP | 2008275946 | A * | 11/2008 |
| JP | 2010-249872 | | 11/2010 |
| JP | 2011095583 | A | 5/2011 |

OTHER PUBLICATIONS

Japanese Office Action dated Dec. 9, 2014, issued in counterpart Japanese Application No. 2012-106007.

* cited by examiner

FIG. 1B

| SOLID WHITE TRANSFER CURRENT | RESISTANCE OF TRANSFER MATERIAL | UPPER LIMIT OF TRANSFER CURRENT | | | | |
|---|---|---|---|---|---|---|
| | | 100 [μA] | 200 [μA] | 300 [μA] | 400 [μA] | 500 [μA] |
| 100 [μA] | HIGH | AA | AA | AA | AA | AA |
| | | AA | AA | AA | AA | AA |
| | | AA | AA | AA | AA | AA |
| 200 [μA] | | AA | A | A | A | A |
| | | A | AA | A | A | A |
| | | B | AA | B | B | B |
| 300 [μA] | | AA | A | B | B | B |
| | | B | B | AA | B | B |
| | | C | AA | AA | C | C |
| 400 [μA] | | D | B | A | C | C |
| | | D | C | C | AA | C |
| | | D | D | AA | AA | D |
| 500 [μA] | LOW | D | D | C | A | D |

γ

| PRINTING SURFACE:TOP, TRANSFER MATERIAL TYPE:PLAIN PAPER | | |
|---|---|---|
| ENVIRONMENTAL CONDITION | ABSOLUTE HUMIDITY A [g/m³] | BIAS VOLTAGE Vt [V] |
| 1 | 0≦A<3 | Vt=Vout+1100 |
| 2 | 3≦A<8 | Vt=Vout+900 |
| 3 | 8≦A<14 | Vt=Vout+700 |
| 4 | 14≦A<21 | Vt=Vout+600 |
| 5 | 21≦A<28 | Vt=Vout+500 |

| TRANSFER MATERIAL WIDTH: 297 [mm] | | |
|---|---|---|
| ENVIRONMENTAL CONDITION | ABSOLUTE HUMIDITY A [g/m³] | UPPER LIMIT [μA] |
| | | |
| 5 | 21≦A<28 | SOLID WHITE TRANSFER CURRENT x1.0 |

IMAGE FORMING APPARATUS HAVING TRANSFER BIAS CONTROL

This appplication is based on Japanese Patent Application No. 2012-106007 filed on May 7, 2012, the content of which is incorporated herein by reference.

BACKGROUND OF THE INVENTION

1. Field of the Invention

The present invention relates to an image forming apparatus including a transfer member which is adapted to sandwich with the transfer member and an image support on which a toner image is supported, so that the toner image is transferred onto the transfer material.

2. Description of Related Art

In a printing process of an electrophotographic image forming apparatus, toner images in their respective colors are transferred onto one another on a transfer belt, which is an example of the image support, (primary transfer), so that a composite toner image is formed. The composite toner image is transferred (secondary transfer) onto a transfer material at a nip (referred to below as a transfer nip) between the transfer belt and a secondary transfer roller, which is an example of the transfer member. Here, examples of the type of the transfer material include plain paper, OHP film, and heavy paper.

At the time of secondary transfer, a transfer bias voltage is applied to the secondary transfer roller. A method for controlling the transfer bias voltage as described in, for example, Japanese Patent Laid-Open Publication No. 2008-275946 (see, for example, FIGS. 2 to 5) will be described below in summary.

In the image forming apparatus, for example, constant current control is performed when the transfer material is not at the transfer nip (referred to below as during non-transfer time), such as at the time of warm-up. During the constant current control, a voltage from a power supply is applied to the secondary transfer roller. An ammeter detects current from the power supply to the secondary transfer roller (referred to below as transfer current). Moreover, a control unit continually monitors the voltage outputted by the power supply. The control unit holds a voltage value Vout of the power supply so that the value detected by the ammeter can be kept at a constant value Icc (e.g., 20 μA).

Furthermore, in the image forming apparatus, a memory unit has a plurality of first tables stored therein. For example, the first table is prepared for each type of transfer material. Moreover, each first table lists a transfer bias voltage calculation formula for each range of absolute humidity. The calculation formula is created in advance on the basis of experiments, etc.

In determining the transfer bias voltage, the control unit initially receives information concerning the type and the size (at least the width) of the transfer material to be used in the current printing process. Specifically, the information is inputted by the user manipulating an operating panel (not shown) of the image forming apparatus before pressing a print start button. The control unit receives a print command, which includes the information, from the operating panel.

Furthermore, the control unit derives absolute humidity around the secondary transfer roller by a well-known method. The control unit refers to the first table to identify a calculation formula on the basis of a combination of the type of the transfer material and the absolute humidity, and assigns, to the calculation formula, a voltage value Vout that is currently being held, thereby calculating a transfer bias voltage.

Thereafter, for example, a scanner included in the image forming apparatus reads an image of a document set by the user, and the control unit acquires image data that represents the read document image.

Furthermore, the memory unit has a plurality of second tables stored therein. For example, the second table is prepared for each combination of a type of transfer material and a coverage. Here, the coverage refers to a proportion of an area occupied by the composite toner image (referred to below as a toner area) to a printable area of the transfer material. Each second table lists at least an upper limit of transfer current for each combination of a width of the transfer material and absolute humidity. The upper limit is obtained in advance on the basis of experiments, etc.

In determining the upper limit of transfer current, the control unit initially analyzes the acquired image data to identify the coverage. The control unit identifies the second table to be used for the current secondary transfer on the basis of the combination of the type of the transfer material and the coverage, and thereafter, the control unit reads the upper limit of transfer current from the identified second table on the basis of the combination of the absolute humidity and the width of the transfer material.

As described earlier, the transfer belt supports the composite toner image thereon. Moreover, the power supply applies the transfer bias voltage to the secondary transfer roller. The composite toner image on the transfer belt is transferred onto the transfer material introduced to the transfer nip (secondary transfer). The above operation from "the constant current control during non-transfer time" to "the derivation and application of the transfer bias voltage" is the same as in a well-known active transfer voltage control (ATVC) method.

During secondary transfer, the ammeter continues to detect the transfer current. If the value detected by the ammeter exceeds the determined upper limit, the control unit performs upper limit current control, thereby gradually changing the transfer bias voltage to the secondary transfer roller. As a result, the transfer current value is kept below the upper limit.

The image forming apparatus described in Japanese Patent Laid-Open Publication No. 2008-275946 performs upper limit current control, so that toner images on the image support can be transferred onto transfer materials of various resistance values with high transfer efficiency. However, suppliers of transfer materials do not necessarily manage resistance values, and some transfer materials distributed in the global market have considerably lower resistance values than transfer materials distributed in the Japanese domestic market. Accordingly, the image forming apparatus is required to transfer a toner image onto such a transfer material with high transfer efficiency.

SUMMARY OF THE INVENTION

An image forming apparatus according to an embodiment of the present invention includes: an image support that supports a toner image; a transfer member adapted to sandwich with the transfer member and the image support; a voltage application unit that applies a transfer bias voltage to the transfer member; a current detecting unit that detects transfer current flowing from the voltage application unit to the transfer material after transfer processing on the transfer material starts; and a control unit that sets an upper limit of transfer current on the basis of a value of the transfer current detected by the current detecting unit, and thereafter further acquires a transfer current value from the current detecting unit to control a transfer bias voltage generated by the voltage application unit, such that the transfer current value during transfer does not exceed the upper limit.

An image forming apparatus according to another embodiment of the present invention includes: an image support that supports a toner image; a transfer member adapted to sandwich with the transfer member and the image support; a voltage application unit that applies a transfer bias voltage to the transfer member; a first current detecting unit that detects transfer current flowing from the voltage application unit to the transfer material after transfer processing on the transfer material starts; a pre-transfer guide member that is provided upstream from the transfer member and is connected to a ground; a second current detecting unit that detects guiding current flowing from the pre-transfer guide member to the ground; and a control unit that acquires values of transfer current and guiding current from the first and second current detecting units, and sets an upper limit of a subtraction value between the transfer current and the guiding current. After the setting of the upper limit of the subtraction value, the control unit further acquires values of transfer current and guiding current from the first and second current detecting units to derive a subtraction value that is to be set during transfer and control a transfer bias voltage generated by the voltage application unit, such that the subtraction value during transfer does not exceed the upper limit.

BRIEF DESCRIPTION OF THE DRAWINGS

FIG. 1B is a table showing upper limits of transfer current with which upper limit current control works for each transfer material resistance value;

DETAILED DESCRIPTION OF THE PREFERRED EMBODIMENTS

Basic Concept

Before describing embodiments of the present invention, the basic concept of each embodiment will be described first. The inventors of the present invention carried out experiments in which "an existing image forming apparatus (existing apparatus) equipped with the upper limit current control function described in Japanese Patent Laid-Open Publication No. 2008-275946 was used to perform secondary transfer processing on transfer materials of different resistance values for each upper limit for transfer current".

Here, the resistance value of a transfer material is substituted with the value of transfer current flowing through a leading section of the transfer material during transfer of a solid white image (referred to below as solid white transfer current) with a transfer bias voltage (constant value) applied to the transfer roller by the well-known ATVC method. The resistance value of the transfer material decreases as the transfer current value increases. Note that the reason for use of the solid white image will be described later.

Specific experimental conditions are shown below.

Maximum current of a transformer included in a power supply of the existing apparatus: 500 μA.

Upper limits of transfer current: five, consisting of 100 μA, 200 μA, 300 μA, 400 μA, and 500 μA.

Transfer current for solid white images (resistance values of transfer materials): 100 μA to 500 μA.

Printing environment: high-humidity environment (e.g., high-temperature and high-humidity (HH) environment at 30° C. and 85% RH).

Width of the transfer material: 297 mm.

Figure 1A:
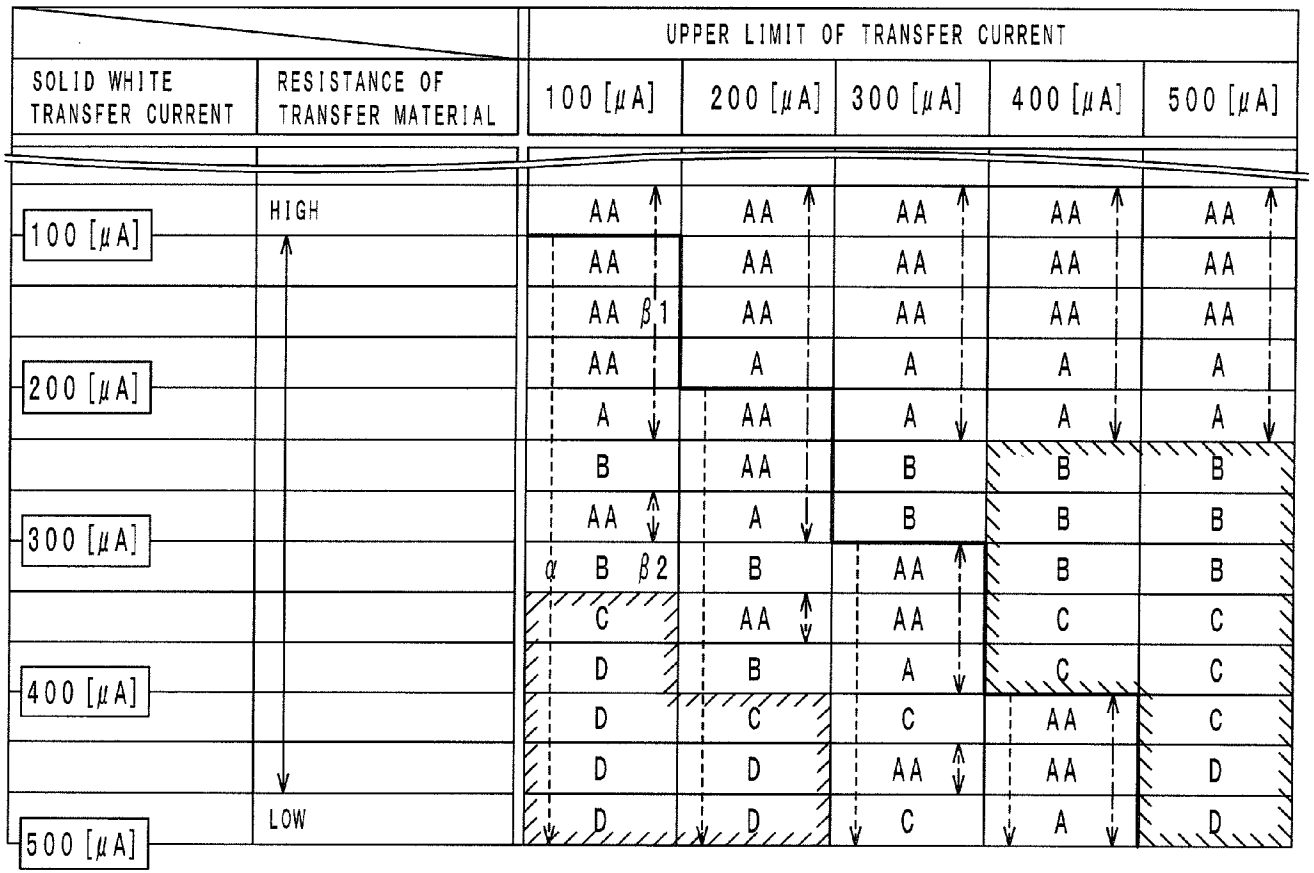
FIG. 1A is a table showing evaluation results for print images obtained by changing a transfer material resistance value for each upper limit.

FIG. 1A shows evaluation results for experimentally obtained print images. In FIG. 1A, the top row shows the upper limits of transfer current, and the left column shows the solid white transfer current values substituting resistance values of transfer materials. In FIG. 1A, the evaluation of the print images is shown for each combination of the upper limit of transfer current and the resistance value of the transfer material. In the present embodiment, the print images were evaluated on the basis of, for example, the weight ratio of the toner transferred onto the transfer material to the toner used in development processing (i.e., transfer efficiency). The evaluation was classified into five grades: AA, A, B, C, and D. The best grade is AA, followed by A, B, C, and D in order. Moreover, grades AA and A represent "appropriateness" as the quality of a print image, and the other grades represent "inappropriateness". Effects of upper limit current control will be described below with respect to examples where the upper limits are 100 μA, 300 μA, and 500 μA.

For example, when the upper limit was 100 μA, the upper limit current control was found to work in the range of transfer current values of 100 μA or more (see dotted arrow α) and produce effects on transfer materials with solid white transfer current approximately in the range of from 67 μA to less than 233 μA (see long dashed short dashed arrow (β1) or approximately in the range of from 267 μA to less than 300 μA (see long dashed short dashed arrow (β2). However, no effect was found to be produced for the resistance values approximately in the range of from 233 μA to less than 267 μA and for the resistance values approximately in the range of from 300 μA to less than 500 μA. Defective transfer possibly caused by the transfer bias voltage being low due to the upper limit current control was found particularly in the solid white transfer current range of about 333 μA or more (in the range hatched with lines running diagonally downward to the left).

Furthermore, for example, when the upper limit was 300 μA, the upper limit current control was found to work at transfer current values in the range of 300 μA or more and produce effects on transfer materials with resistance values approximately in the range of from 233 μA to less than 300 μA, approximately in the range of from 400 μA to less than 433 μA, or approximately in the range of from 467 μA to less than 500 μA.

Furthermore, when the upper limit was 500 μA, the upper limit current control did not work. As mentioned above, the maximum current of the transformer was 500 μA, and therefore current higher than that did not flow to the secondary transfer roller. Accordingly, in this case, only the ATVC might as well have been performed in the existing apparatus, and therefore, transfer materials with resistance values approximately in the range of from 233 μA to less than 500 μA (in the range hatched with lines running diagonally downward to the right) experienced decrease in transfer efficiency due to overvoltage, resulting in inappropriate print image quality.

From the above experiment results, it can be appreciated that the upper limit current control produces effects on transfer materials of a wider range of resistance values when compared to the case where only the ATVC is performed (i.e., in the case where the upper limit is 500 μA). On the other hand, from the above experiment results, it can also be appreciated that the range of resistance values for which the upper limit current control works varies among the upper limits of transfer current, and with a method in which the upper limit is determined without detecting transfer current that flows to an actual transfer material as in conventional upper limit current control, it is extremely difficult to print high-quality images on transfer materials of a wider range of resistance values.

In further review of the above experiment results, it was found that for each resistance value of the transfer materials, there is an upper limit of transfer current that allows high-quality image printing, as indicated by dotted eclipse γ in FIG. 1B. For example, in the example shown in the figure, by setting the upper limit of transfer current to the value of solid white transfer current×1.0, it is rendered possible to allow the upper limit current control to effectively work for transfer materials S with resistance values ranging from high to extremely low. In view of the foregoing, image forming apparatuses of the following embodiments determine appropriate upper limits of transfer current on the basis of measurement results for resistance values of transfer materials (values of transfer current flowing to the transfer materials), so that high-quality images can be printed on transfer materials of a wider range of resistance values than conventional.

First Embodiment

Hereinafter, an image forming apparatus according to a first embodiment of the present invention will be described with reference to FIGS. 2 to 7. In the accompanying drawings of the present specification, the uppercase alphabet letters Y, M, C, and K that follow reference numerals are suffixes that denote yellow, magenta, cyan, and black. For example, photoreceptor drum 4Y denotes a photoreceptor drum 4 for yellow.

Configuration of Image Forming Apparatus

Figure 2:
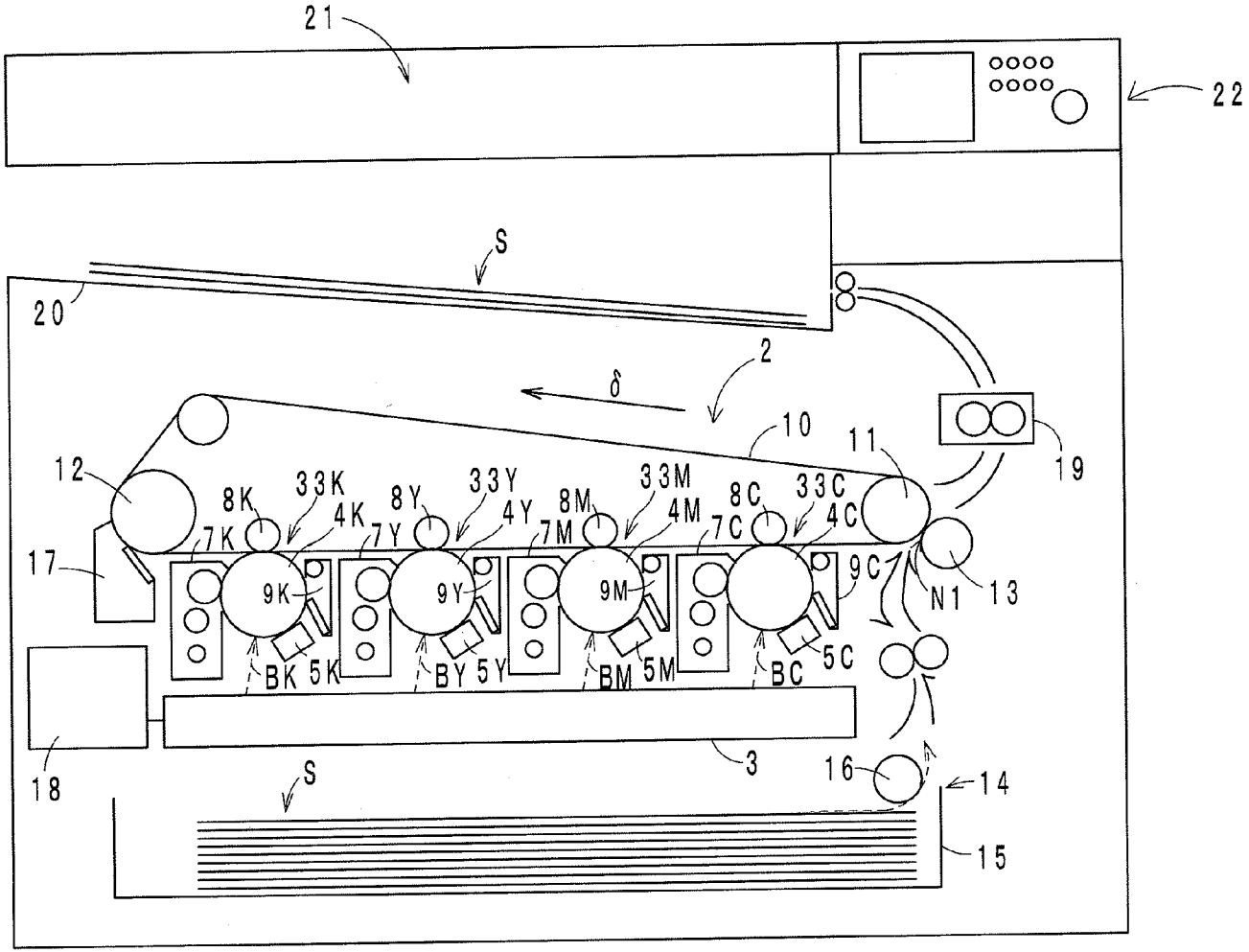
FIG. 2 is a schematic diagram illustrating the internal configuration of an image forming apparatus according to each embodiment of the present invention.

In FIG. 2, the image forming apparatus 1 is an electrophotographic tandem color printer or suchlike, and includes a printing unit 2, a supply unit 14, a control unit 18, which is a CPU or suchlike, an output tray 20, a scanner 21, and an operating panel 22.

The scanner 21 reads an image of a document set by the user and generates image data that represents the document image with the three primary colors R (red), G (green), and B (blue). The control unit 18 converts this RGB image data into image data that represents the document image with Y, M, C, and K.

The operating panel 22 outputs a variety of types of information and commands to the control unit 18 in accordance with the user's operation.

The supply unit 14 includes a supply tray 15 and a supply roller 16. In the supply tray 15, a plurality of unprinted transfer materials S are stacked. The supply roller 16 picks up the transfer materials one by one from the stack in the supply tray 15, and feeds them downstream toward a transfer nip N1.

The printing unit 2 includes imaging units 33, one for each color, an exposing device 3, primary transfer rollers 8, one for each color, a transfer belt 10, a drive roller 11, a driven roller 12, a secondary transfer roller 13, a cleaning blade 17, and a fusing device 19. Moreover, each of the imaging units 33 includes a photoreceptor drum 4, a charger 5, a developing device 7, and a cleaner 9.

The charger 5 charges the circumferential surface of the photoreceptor drum 4. The exposing device 3 receives YMCK image data from the control unit 18, and generates optical beams B modulated with image data for their respective colors, using an internal light source. Each of the optical beams B is emitted such that the circumferential surface of the photoreceptor drum 4 for its corresponding color is illuminated along a main scanning direction while the photoreceptor drum 4 is rotating in a sub-scanning direction. As a result, electrostatic latent images are formed on the circumferential surfaces of the photoreceptor drums 4 for their respective colors. For each color, the developing device 7 supplies toner onto the circumferential surface of its corresponding photoreceptor drum 4, thereby forming a toner image in that color on the circumferential surface of the photoreceptor drum 4.

Each of the primary transfer rollers 8 transfers the toner image on its corresponding photoreceptor drum 4 onto the transfer belt 10 stretched between the drive roller 11 and the driven roller 12, so that the toner images for all colors are put on one another to generate a composite toner image on the transfer belt 10. The transfer belt 10 is an example of an image support for carrying toner images, and is made of, for example, polyimide.

The drive roller 11 is caused to rotate by an unillustrated motor, thereby driving the transfer belt 10 in the direction of arrow 8 in FIG. 2. Accordingly, the surface of the drive roller 11 is preferably made of a material with a high friction coefficient, such as rubber or urethane.

The secondary transfer roller 13 is an example of a transfer member, and forms the transfer nip N1 by contacting the transfer belt 10 to transfer the composite toner image onto the transfer material S. In the present embodiment, the length of the transfer nip N1 is assumed to be 2 mm. The secondary transfer roller 13 and the transfer belt 10 sandwich the transfer material S fed from the supply roller 16, at the transfer nip N1. The secondary transfer roller 13 is made of, for example, an ion-conductive material or urethane rubber. An example of the ion-conductive material is nitrile butadiene rubber (NBR).

The composite toner image is fed to the position of the transfer nip N1 by the transfer belt 10 being driven. The secondary transfer roller 13 has a transfer bias voltage applied thereto, so that the composite toner image is attracted toward the secondary transfer roller 13 by means of the transfer bias voltage, and transferred onto the transfer material S introduced to the transfer nip N1 (secondary transfer processing). The transfer material S subjected to secondary transfer processing is forwarded from the transfer nip N1 toward the fusing device 19.

Upon introduction of the transfer material S from the transfer nip N1, the fusing device 19 heats and presses the transfer material S, thereby fixing the composite toner image on the transfer material S (fusing processing). The transfer material S subjected to fusing processing is ejected and placed in the output tray 20 as a print.

Components around Transfer Nip

Figure 3:
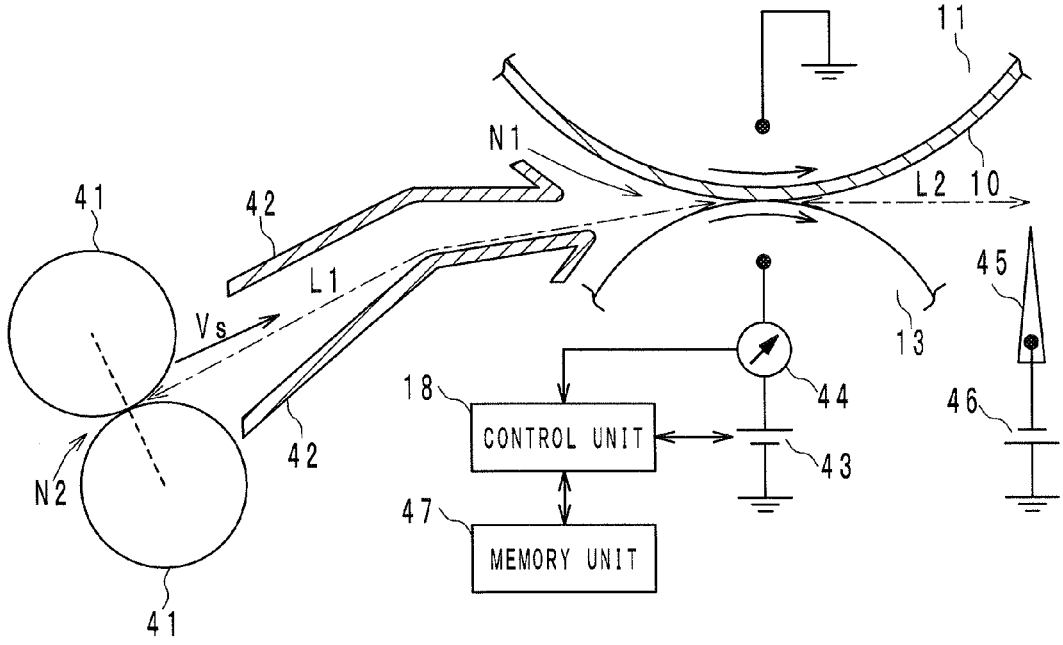
FIG. 3 is a schematic diagram illustrating components around a secondary transfer roller in a first embodiment.

In FIG. 3, components provided around the transfer belt 10, the drive roller 11, and the secondary transfer roller 13 at least include a pair of registration rollers 41, pre-transfer guides 42, a transfer power supply circuit 43, which is an example of a first voltage application unit, a current sensor 44, which is an example of a current detecting unit, a separation and discharge brush 45, which is an example of a separation and discharge unit, and a discharging power supply circuit 46. Moreover, the control unit 18 is electrically connected to the power supply circuit 43 and the current sensor 44, and performs ATVC and upper limit current control using relational expressions (to be described later) pre-stored in a memory unit 47.

The pair of registration rollers 41 contact each other to form a registration nip N2. The pre-transfer guides 42 are made of metal or resin, and provided between the registration nip N2 and the transfer nip N1. The pre-transfer guides 42 form a feed path having a predetermined length L1.

The power supply circuit 43 is connected to the secondary transfer roller 13 via a power supply line, and applies a voltage (typically, a transfer bias voltage) of a value set by the control unit 18, to the roller 13. Moreover, the current sensor 44 detects current (transfer current) flowing through the power supply line.

The separation and discharge brush 45 is disposed at a predetermined distance L2 (e.g., 2 cm) downstream from the transfer nip N1. Moreover, the power supply circuit 46 is connected to the separation and discharge brush 45. The power supply circuit 46 applies a voltage to the separation and discharge brush 45, whereby the separation and discharge brush 45 removes static electricity from the transfer material S forwarded from the transfer nip N1.

The memory unit 47 has a relational expression between the upper limit of transfer current and solid white transfer current stored for each set of printing conditions. Here, the printing conditions in the present embodiment are, for example, an ambient temperature and ambient humidity (i.e., absolute humidity) around the transfer nip N1, and the width of the transfer material S. For example, in the printing conditions where the ambient temperature and the ambient humidity are 30° C. and 85% RH, and the width of the transfer material S is 297 mm, the relational expression to be applied is such that the upper limit of transfer current=solid white transfer current×1.0, as mentioned earlier (see FIG. 1B).

Note that for convenience of explanation, only the relational expressions that are applied under the aforementioned printing conditions are exemplified in the present embodiment, but in actuality, the memory unit 47 holds relational expressions for various sets of printing conditions.

Image Printing Process (ATVC/Upper Limit Current Control)

Figure 4:
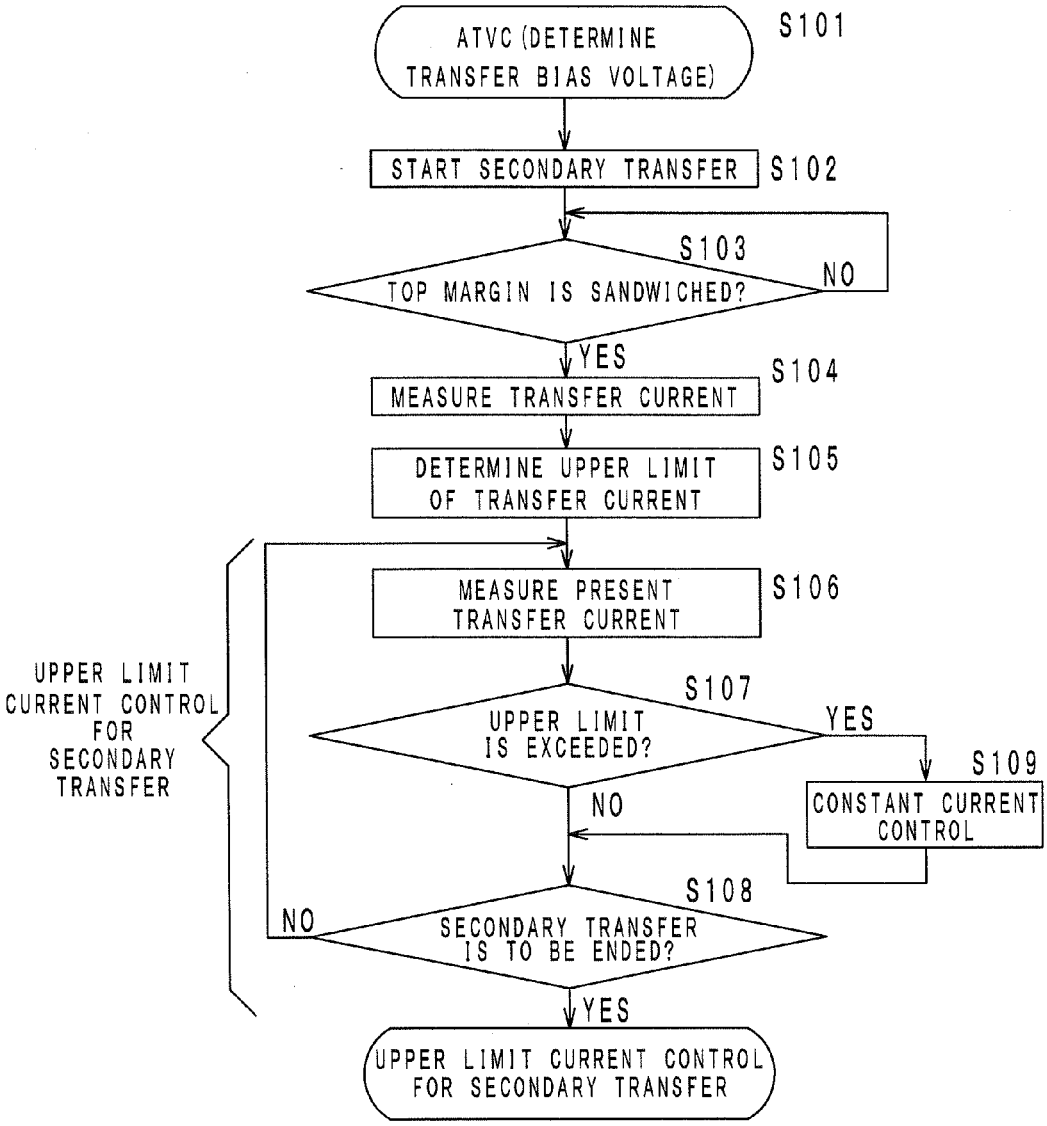
FIG. 4 is a flowchart showing an operation of the image forming apparatus in the first embodiment.

Hereinafter, the operation of the image forming apparatus 1 will be described in detail with reference to a flowchart of FIG. 4.

Figure 5:
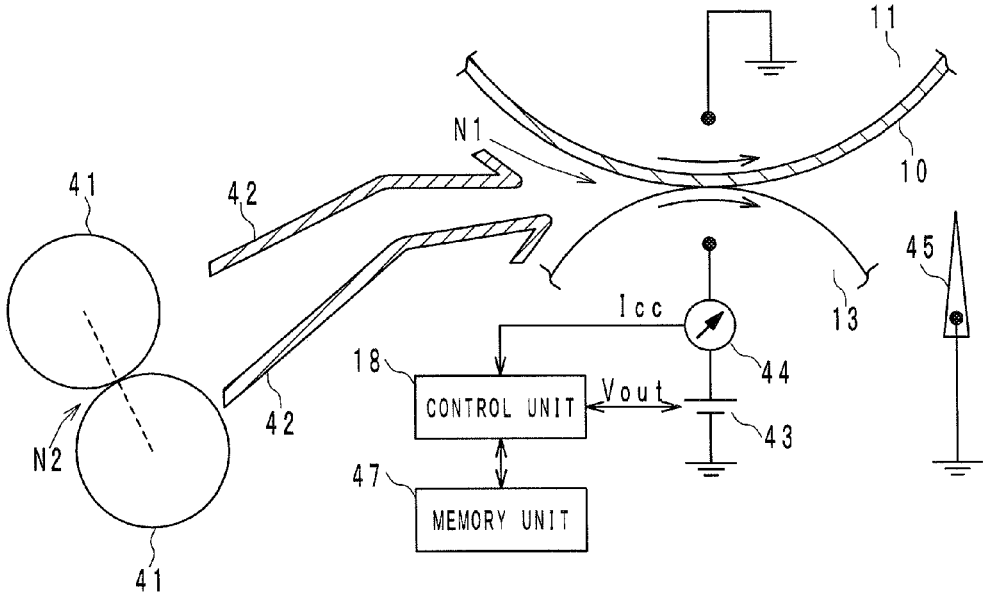
FIG. 5 is a schematic diagram illustrating constant current control by ATVC.

In an image printing process, the control unit 18 obtains an initial value for a transfer bias voltage through ATVC during non-transfer time (S101). The operation of each component in S101 is described in detail in Japanese Patent Laid-Open Publication No. 2008-275946, and therefore, only some essential points will be explained herein. The control unit 18 performs constant current control with the secondary transfer roller 13 and the transfer belt 10 in contact with each other as shown in FIG. 5. In the constant current control, the control unit 18 adjusts a voltage outputted by the power supply circuit 43, such that the current sensor 44 detects a predetermined constant current value Icc (e.g., 20 μA). The control unit 18 continually monitors the output voltage of the power supply circuit 43, and holds an output voltage value Vout when the value detected by the current sensor 44 is equal to the constant current value Icc. The control unit 18 performs the constant current control for a predetermined period of time, holds a plurality of output voltage values Vout, and calculates an average thereof.

Furthermore, the user sets a document on the scanner 21 (see FIG. 2), and thereafter manipulates the operating panel 22 to enter the size and the type of a transfer material S to be used in the current printing process. Upon completion of the entry, the user presses a print start button on the operating panel 22. As a result, the operating panel 22 transmits a print command, including the information entered by the user, to the control unit 18. In this manner, the control unit 18 acquires the size and the type of the transfer material S to be used in the current printing process.

The control unit 18 further calculates absolute humidity using a well-known method on the basis of values detected by temperature and humidity sensors (not shown) provided near the transfer nip N1.

Here, in addition to the aforementioned relational expressions, the, memory unit 47 has stored therein a table listing transfer bias voltages Vt that correspond to ambient absolute humidity for each type of transfer material S. The transfer bias voltage Vt is expressed by equation (2) below.

$$Vt=a\times Vout+b \quad (2)$$

Here, in the present embodiment, Vout denotes an average of output voltage values. Moreover, the factor of proportionality a and the offset b are determined on the basis of results of experiments previously conducted under a plurality of sets of printing conditions (typically, the type of transfer material and absolute humidity). Explaining the equation (Vt=Vout+1100) in the first row of table T shown in FIG. 6 as a representative example, this equation is used where the type of transfer material is plain paper, and absolute humidity A [g/m$^3$] is $0\leq A<3$. Moreover, in this equation, the constant of proportionality a is 1, and the offset b is 1100.

Figure 6:
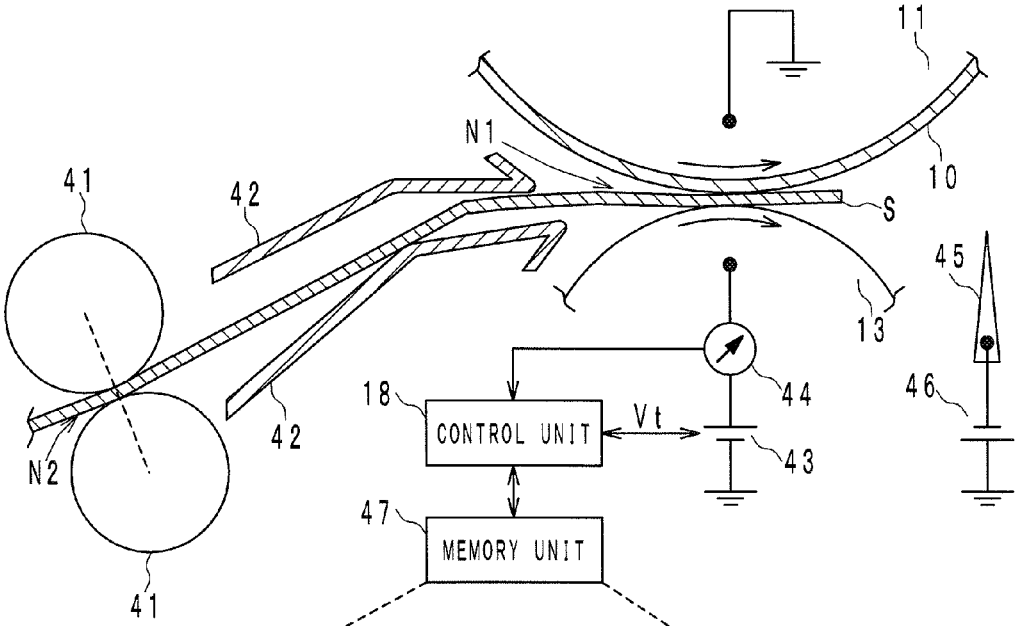
FIG. 6 is a schematic diagram illustrating a process for calculating a transfer bias voltage.

At this point, the control unit 18 holds the type of the transfer material S, the absolute humidity around the transfer nip N1, and the average of output voltage values Vout. On the basis of this information, the control unit 18 identifies a transfer bias voltage calculation formula in the memory unit 47 that matches the printing conditions, as shown in FIG. 6. The control unit 18 assigns the average of output voltage values Vout to the identified calculation formula, thereby obtaining a transfer bias voltage Vt. Thereafter, the power supply circuit 43 applies the transfer bias voltage Vt to the secondary transfer roller 13 under control of the control unit 18. The control unit 18 performs constant voltage control such that the transfer bias voltage Vt is substantially maintained. This concludes the description of the operation of each component in 5101.

Referring again to FIG. 4, in S102 following S101, the unprinted transfer material S is pressed against the registration nip N2, and the transfer material S is forwarded from the registration nip N2 toward the transfer nip N1 at feed speed Vs under control of the control unit 18 for the timing of secondary transfer. The transfer material S is guided through the feed path formed by the pre-transfer guides 42, and introduced to the transfer nip N1, so that secondary transfer starts.

Furthermore, the control unit 18 counts time from when the transfer material S starts to be forwarded from the transfer nip N1. Moreover, from the feed speed Vs and the feed path length L1 (see FIG. 3), it is possible to know the time the top margin (e.g., about 5 mm) of the transfer material S reaches and passes the transfer nip N1. Once secondary transfer starts, the control unit 18 determines whether or not the margin of the transfer material S is sandwiched at the transfer nip N1, on the basis of the counted time value (S103).

When the determination in S103 is YES, the control unit 18 acquires a transfer current detection value from the current sensor 44 (S104). At this time, since the margin of the transfer material S is sandwiched at the transfer nip N1, the detection value acquired in S104 is the value of the aforementioned solid white transfer current.

Figure 7:
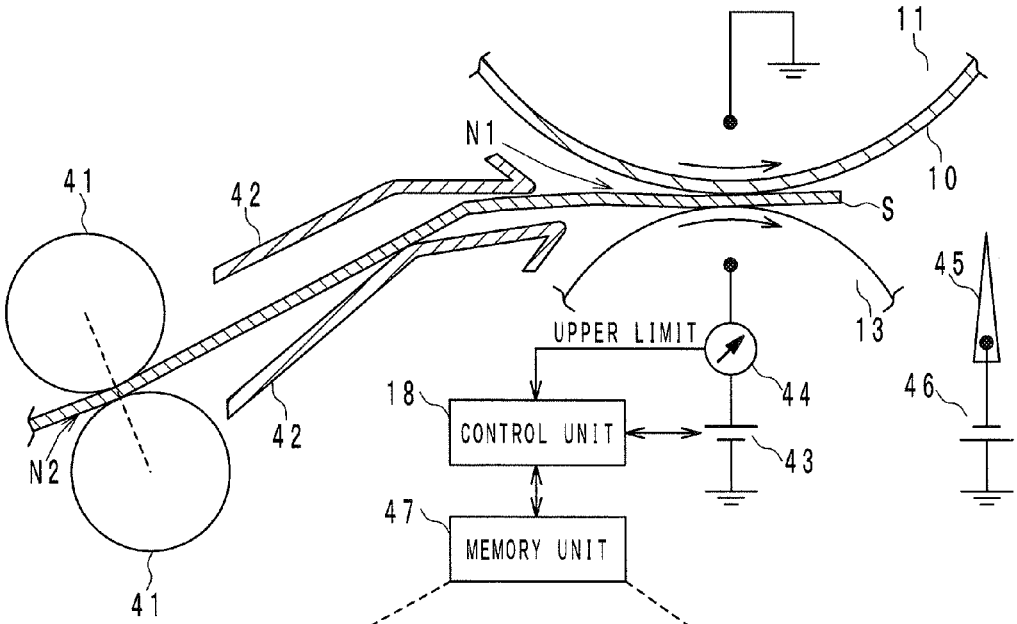
FIG. 7 is a schematic diagram illustrating a process for deriving an upper limit of transfer current.

Next, the control unit 18 accesses the memory unit 47 to identify the relational expression between the upper limit of transfer current and solid white transfer current that matches the current printing conditions, and assigns the solid white transfer current value detected in S104 to the relational expression, thereby obtaining the upper limit of transfer current, as shown in FIG. 7 (S105). For example, in the case where the ambient temperature is 30° C., the ambient humidity is 85% RH, and the width of the transfer material is 297 mm, the relational expression that the upper limit of transfer current =solid white transfer current×1.0 is identified. Moreover, when the solid white transfer current detected in S104 is 100 μA, the upper limit of transfer current is set to 100 μA.

Upon completion of S105, upper limit current control for secondary transfer is performed. Specifically, the control unit 18 acquires a transfer current value from the current sensor 44 (S106), and determines whether or not the transfer current during transfer exceeds the upper limit (S107). When the determination is NO, the control unit 18 considers that secondary transfer can be performed with high efficiency, and thereafter determines whether or not it is the time to end secondary transfer (S108). On the other hand, when the determination in S107 is YES, the control unit 18 executes S108 after performing constant current control to adjust the transfer bias voltage Vt such that the value detected by the current sensor 44 falls to or below the upper limit of transfer current (S109). The series of processing steps from S106 is repeated until the determination in S108 turns to be YES.

Second Embodiment

An image forming apparatus according to a second embodiment has different components around the transfer nip N1 when compared to the image forming apparatus according to the first embodiment. There is no other difference in configuration. Therefore, components in the second embodiment that correspond to those in the first embodiment are denoted by the same reference characters, and any descriptions thereof will be omitted.

Components Around Transfer Nip

Figure 8:
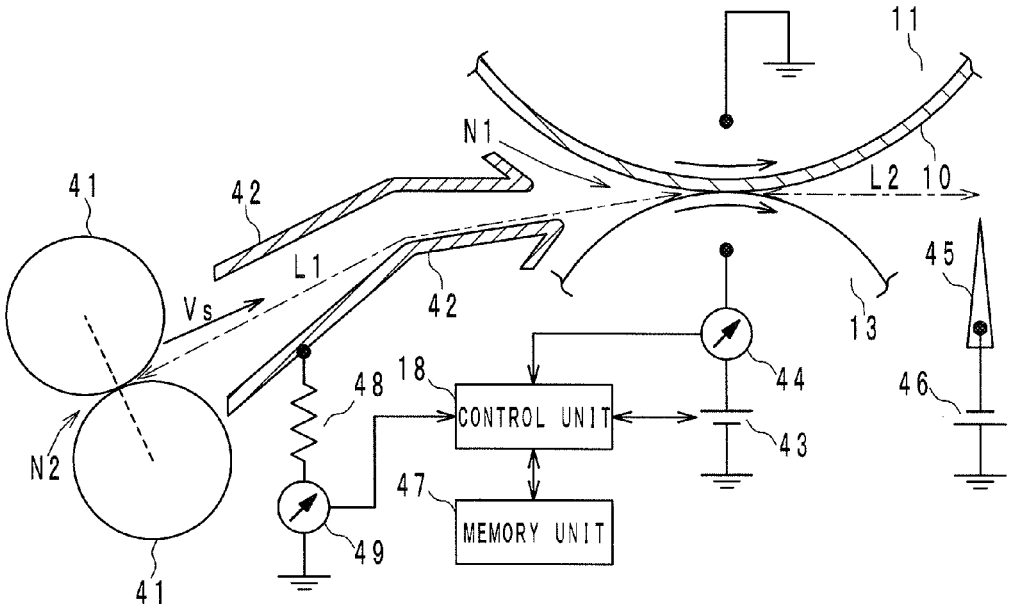
FIG. 8 is a schematic diagram illustrating components around a secondary transfer roller in a second embodiment.

FIG. 8 is a schematic diagram illustrating components around the transfer nip N1 of the image forming apparatus 1 according to the second embodiment. These peripheral components in FIG. 8 differ from those in FIG. 3 in that the pre-transfer guides 42 are grounded via a resistance 48, and a current sensor 49, which is an example of a second current detecting unit, is provided. There is no other difference in peripheral components between the figures. Therefore, components in FIG. 8 that correspond to those shown in FIG. 3 are denoted by the same reference characters, and any descriptions thereof will be omitted. Note that in the present embodiment, the current sensor 44 is an example of a first current detecting unit.

As described in the first embodiment, the transfer material S is introduced to the transfer nip N1 after traveling through the pre-transfer guides 42. Accordingly, the entire current (transfer current) from the power supply circuit 43 does not flow through the transfer material S to a ground connected to the drive roller 11, but some of the current flows through the transfer material S to the pre-transfer guides 42 as guiding current, and ultimately reaches the ground connected to the pre-transfer guides 42. Accordingly, unlike in the first embodiment, the upper limit control is performed on the basis of differential current, which is obtained by deducting the guiding current from the transfer current.

For the image forming apparatus 1 thus configured, similar experiments to those described with reference to FIGS. 1A and 1B were conducted in advance. As a result, it was found that, for example, by setting the upper limit of differential current to the value of solid white transfer current×1.4, it is rendered possible to allow the upper limit current control to effectively work for transfer materials S with resistance values ranging from high to extremely low.

Figure 9:
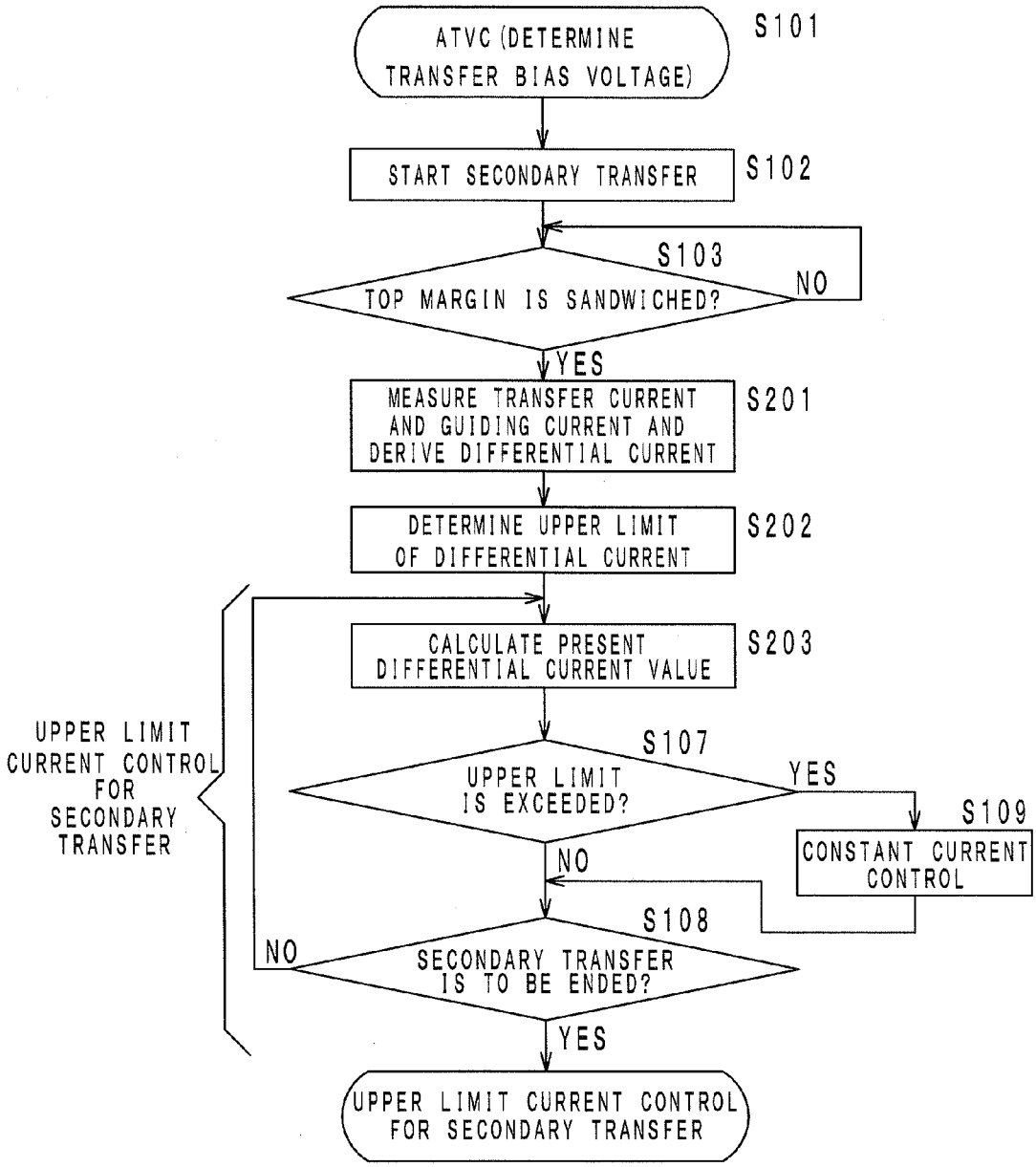
FIG. 9 is a flowchart showing an operation of the image forming apparatus in the second embodiment.

FIG. 9 is a flowchart showing an operation of the image forming apparatus 1 according to the second embodiment. FIG. 9 differs from FIG. 4 in that S201 through S203 are included in place of S104 through S106. There is no other difference between the flowcharts. Therefore, steps in FIG. 9 that correspond to those in FIG. 4 are denoted by the same step numbers, and any descriptions thereof will be omitted.

In S201, the control unit 18 acquires a transfer current value and a guiding current value from the current sensors 44 and 49, and derives a differential current value. Next, in S202, the control unit 18 sets the upper limit of differential current to the value of solid white transfer current×1.4. Moreover, after setting the upper limit of differential current as such, the control unit 18 in S203 acquires a transfer current value that is to be set during transfer, from the current sensor 44, and also a present guiding current value from the current sensor 49, and thereafter derives a differential current value that is to be set during transfer. Subsequently, the control unit 18 performs constant current control such that the differential current value during transfer does not exceed the upper limit.

Actions and Effects of First and Second Embodiments

As described above, in the first embodiment, the upper limit of transfer current that allows high-quality image printing is experimentally obtained for each solid white transfer current value (i.e., for each resistance value of transfer materials S), and is stored in the memory unit 47 beforehand. Immediately after the start of secondary transfer, the control unit 18 detects solid white transfer current of a transfer material S (i.e., the resistance value of the transfer material S), and determines the upper limit of transfer current that is appropriate for the detected resistance value of the transfer material S. The control unit 18 performs constant current control such that transfer current detected by the current sensor 44 does not exceed the upper limit during upper limit control. Under such constant current control, the transfer material S is subjected to secondary transfer of a composite toner image, and therefore, composite toner images can be transferred onto transfer materials in a wide range of resistance values, including extremely low values, with satisfactory transfer efficiency.

Furthermore, in the second embodiment, constant current control is performed on differential current, while considering guiding current flowing through the pre-transfer guides 42, which makes it possible to provide an image forming apparatus capable of transferring composite toner images onto transfer materials in a wide range of resistance values, including extremely low values, with satisfactory transfer efficiency.

Figure 10:
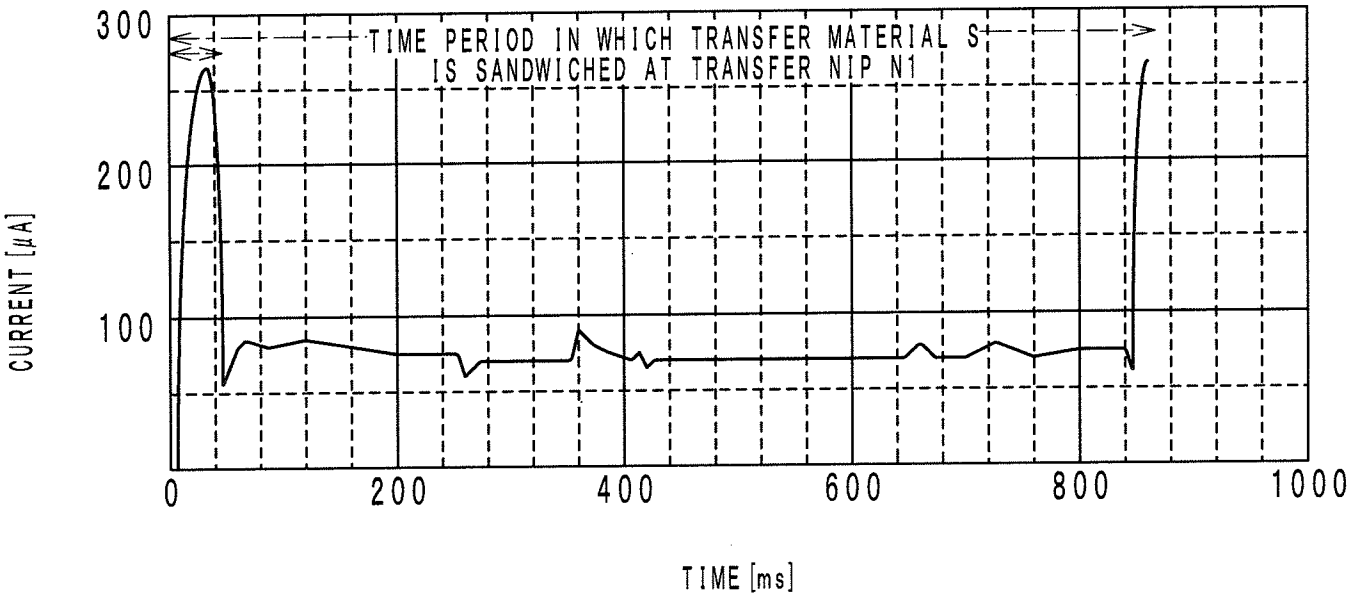
FIG. 10 is a graph showing a transfer current measurement result for a solid blue image.

Furthermore, in each embodiment, the resistance value of a transfer material S is substituted by a solid white transfer current value. The reasons for using a solid white image are as follows. The resistance value of the transfer material S during secondary transfer varies in accordance with the amount of toner to be transferred. FIG. 10 shows a measurement result for transfer current during secondary transfer of a solid blue image. In FIG. 10, a solid white portion in a leading section of a transfer material S is sandwiched at the transfer nip N1 approximately up to the 50 ms point. In this time slot, the maximum transfer current value is about 260 μA. Thereafter, the solid blue image is transferred onto the transfer material S approximately between the 50 ms point and the 850 ms point. In this time slot, the maximum transfer current value is about 70 μA. In the example of FIG. 8, the transfer current value varies approximately in the range of from 70 μA to 260 μA in accordance with the amount of toner. Therefore, it is necessary that transfer materials S used in experiments and transfer materials S used in actual printing processes are equal in condition in terms of the amount of toner. In actual printing processes, the transfer material S has a margin in its leading section, and the margin corresponds to a solid white image. By using transfer current for the margin, it is rendered possible to allow actual printing processes to be substantially equal to experiments in condition in terms of the amount of toner. For the reasons as described, the resistance value of the transfer material S is substituted by the solid white transfer current value.

Furthermore, in each embodiment, the upper limit of transfer current is determined using the value of transfer current in the leading section (about 5 mm) of the transfer material S. The reasons for this are as follows. In the example of FIG. 3, the separation and discharge brush 45 to which the power supply circuit applies voltage is provided at distance L2 (about 2 cm) downstream from the transfer nip N1. Once the transfer material S reaches the tip of the separation and discharge brush 45, positive charge on the surface of the transfer material S that faces the separation and discharge brush 45 moves to the separation and discharge brush 45. Specifically, in this state, current flows through the separation and discharge brush 45 to the ground, so that it is highly probable that the control unit 18 cannot acquire a correct transfer current value. Accordingly, the possibility of acquiring a correct transfer current value is increased by performing S104 (see FIG. 4) before the transfer material S reaches the separation and discharge brush 45.

Supplementary

Note that the lower limit of transfer current can be determined by a method as used in Japanese Patent Laid-Open Publication No. 2008-275946, and therefore any description thereof is omitted in each embodiment.

In the first embodiment, the upper limit current value is derived from the value of solid white transfer current×1.0, and in the second embodiment, the upper limit current value is derived from the value of solid white transfer current×1.4. These relational expressions are not general expressions, and are determined for each image forming apparatus 1 in accordance with printing speed, print size, etc.

Furthermore, in the first embodiment, the value of transfer current may be detected more than once using a margin in a leading section of a transfer material S, and the control unit 18 may determine an upper limit of transfer current using an average of the transfer current values in 5104. In the second embodiment, the control unit 18 may obtain the value of differential current more than once, and may determine an upper limit of transfer current using an average of the differential current values.

Furthermore, in each embodiment, the value of transfer current is measured using a margin in a leading section of a transfer material S. However, any portion other than the leading section can also be used to measure the value of transfer current so long as it is a solid white image portion. In this case, well-known coverage information is used to identify a solid white image portion of the transfer material S.

Furthermore, the relationship between transfer current and its upper limit is corrected on the basis of toner amount information obtained from image data, thereby allowing an image portion of the transfer material S to be used for measuring transfer current.

Furthermore, in the first embodiment, values of the current that flows to the separation and discharge brush 45 are experimentally obtained beforehand, and data for the current values is held in the memory unit 47, so that even after a transfer material S reaches the close proximity of the separation and discharge brush 45, the transfer current to the transfer material S can be obtained by subtracting the value of the current to the separation and discharge brush 45 from a value detected by the current sensor 44. Moreover, in the second embodiment, the value of the transfer current to the transfer material S can be obtained by subtracting the value of the current to the separation and discharge brush 45 from the transfer current value obtained in S202.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

an image support that supports a toner image;

a transfer member adapted to sandwich a transfer material between the transfer member and the image support;

a voltage application unit that applies a transfer bias voltage to the transfer member;

a current detecting unit that detects a first transfer current flowing from the voltage application unit through a leading section of the transfer material after transfer processing on the transfer material starts;

a control unit that sets an upper limit of transfer current based on a value of the first transfer current detected by the current detecting unit, and thereafter further acquires a second transfer current value from the current detecting unit to control the transfer bias voltage generated by the voltage application unit, such that the second transfer current value during the transfer processing does not exceed the upper limit; and a separation and discharge unit that is provided downstream from the transfer member and that removes static electricity from the transfer material subjected to the transfer processing;

wherein the leading section of the transfer material is defined by a range from (i) a leading edge of the transfer material to (ii) a point on the transfer material subjected to the transfer processing before the leading edge of the transfer material subjected to the transfer processing reaches the separation and discharge unit.

2. The image forming apparatus according to claim 1, wherein, to allow the control unit to determine the upper limit of transfer current, the current detecting unit detects transfer current flowing through a portion of the leading section of the transfer material that includes no toner image after the transfer processing on the transfer material starts.

3. An image forming apparatus comprising:

an image support that supports a toner image;

a transfer member adapted to sandwich a transfer material between the transfer member and the image support;

a voltage application unit that applies a transfer bias voltage to the transfer member;

a first current detecting unit that detects a transfer current flowing from the voltage application unit through the transfer material after transfer processing on the transfer material starts;

a pre-transfer guide member that is provided upstream from the transfer member and is connected to a ground;

a second current detecting unit that detects a guiding current flowing from the pre-transfer guide member to the ground; and a control unit that acquires values of the transfer current and the guiding current from the first and second current detecting units, and sets an upper limit of a subtraction value between the transfer current and the guiding current, wherein, after the control unit sets the upper limit of the subtraction value, the control unit further acquires the values of the transfer current and the guiding current from the first and second current detecting units to derive the subtraction value that is to be set during the transfer processing and to control the transfer bias voltage generated by the voltage application unit, such that the subtraction value during the transfer processing does not exceed the upper limit.

4. The image forming apparatus according to claim 3, wherein, to allow the control unit to determine the upper limit of the subtraction value, the first current detecting unit detects transfer current flowing through a portion of the transfer material that includes no toner image after the transfer processing on the transfer material starts.

5. The image forming apparatus according to claim 3, wherein, to allow the control unit to determine the upper limit of the subtraction value, the first current detecting unit detects transfer current flowing through a leading section of the transfer material after the transfer processing on the transfer material starts.

6. The image forming apparatus according to claim 5, further comprising a separation and discharge unit that is provided downstream from the transfer member and that removes static electricity from the transfer material subjected to the transfer processing, wherein the leading section of the transfer material is defined by a range to a point where a leading edge of the transfer material subjected to the transfer processing reaches the separation and discharge unit.

* * * * *